US012607374B1

(12) United States Patent
Ritter

(10) Patent No.: US 12,607,374 B1
(45) Date of Patent: Apr. 21, 2026

(54) PORTABLE MIST FAN AND TANK APPARATUS AND METHOD

(71) Applicant: Brad Ritter, Pensacola, FL (US)

(72) Inventor: Brad Ritter, Pensacola, FL (US)

( * ) Notice: Subject to any disclaimer, the term of this patent is extended or adjusted under 35 U.S.C. 154(b) by 217 days.

(21) Appl. No.: 18/675,393

(22) Filed: May 28, 2024

Related U.S. Application Data

(63) Continuation-in-part of application No. 16/944,211, filed on Jul. 31, 2020, now abandoned.

(51) Int. Cl.
*F24F 6/14* (2006.01)
*F24F 6/00* (2006.01)

(52) U.S. Cl.
CPC ..... *F24F 6/14* (2013.01); *F24F 2006/008* (2013.01); *F24F 2006/146* (2013.01); *F24F 2221/125* (2013.01)

(58) Field of Classification Search
CPC .. F24F 6/14; F24F 2006/008; F24F 2006/146; F24F 2221/125
See application file for complete search history.

(56) References Cited

U.S. PATENT DOCUMENTS 9,091,452 B2 * 7/2015 Yen ..... F04D 19/002
2006/0032259 A1 * 2/2006 White ..... F24F 1/0073 62/314
2015/0247644 A1 * 9/2015 Stearns ..... F24F 5/0035 261/37
2015/0354835 A1 * 12/2015 Chang ..... F24F 1/022 62/125
2016/0008827 A1 * 1/2016 Chan ..... F04D 25/084 417/70
2018/0149378 A1 * 5/2018 Schock ..... F24F 7/007

FOREIGN PATENT DOCUMENTS

DE 4408932 A1 * 9/1994 ..... B65D 43/0212
WO WO-2024239958 A1 * 11/2024 ..... F04D 19/002

* cited by examiner

*Primary Examiner* — Frantz F Jules
*Assistant Examiner* — Emmanuel E Duke
(74) *Attorney, Agent, or Firm* — J. Nevin Shaffer, Jr.

(57) ABSTRACT

An improved portable mist fan and tank apparatus and method consisting of a round lid with a base receiver recess, a pump, a fan where a pump outlet is located in proximity to the fan, a base connected with the pump and the fan, the base configured to fit within and be retained by the base receiver recess and a tank with an exterior with a round top and a bottom and an interior, where the round lid is rotatably attached with the round top of the tank where the exterior bottom of the tank matches the base receiver recess and where the interior has a bottom recess where the interior bottom recess is configured to match the base such that the base fits within and is retained by the interior bottom recess.

20 Claims, 10 Drawing Sheets

PORTABLE MIST FAN AND TANK APPARATUS AND METHOD

CROSS REFERENCE TO RELATED APPLICATIONS

This application claims the benefit of previously filed U.S. provisional patent application No. 62/882,222 filed Aug. 2, 2019 for a "Portable Mist Fan Apparatus and Method". The Applicant hereby claims the benefit of this provisional application under 35 U.S.C. § 119. The entire content of this provisional application is incorporated herein by this reference. Further, this application is a Continuation in Part of pending U.S. patent application Ser. No. 16/944,211 filed Jul. 31, 2020 entitled "Portable Mist Fan Apparatus and Method" The Applicant hereby claims the benefit of the non-provisional application under 35 U.S.C. § 120. The entire content of the non-provisional application is incorporated herein by this reference.

FIELD OF THE DISCLOSURE

The present invention pertains to an improved portable mist fan and tank apparatus consisting of a round lid with a base receiver recess, a pump where the pump includes an inlet and an outlet for fluid, a fan where the pump outlet is located in proximity to the fan, a base connected with the pump and the fan, the base configured to fit within and be retained by the base receiver recess when the base is located on the round lid and a tank with an exterior with a round top and a bottom and an interior for containing fluid, where the round lid is rotatably attached with the round top of the tank such that movement of the base moves the round lid and where the exterior bottom of the tank matches the base receiver recess such that the exterior bottom of the tank fits within the base receiver recess of the round lid when the base is removed and where the interior has a bottom recess where the interior bottom recess is configured to match the base such that the base fits within and is retained by the interior bottom recess when the base is located within the interior of the tank.

BACKGROUND OF THE INVENTION

Human comfort is an ever changing issue. The environment within which we exist often is too hot, too dry, too smelly or too bug infested to be comfortable. Fans help with heat, humidifiers help with dryness and bug sprays help with bugs. There are a number of devices in the prior art designed to address these issues. In particular there are so called "misters" which use a fan and a pump to blow water mist into the air. These devices as they currently exist are inadequate in several ways and have failed to be widely accepted as a result. By way of example, one major problem exists with prior art misters which all require a large water tank. The fan and pump sit on a top of the tank and this works adequately until the fan and/or pump are moved to direct mist in a different direction. Presently, what happens when the fan and pump are turned is that the movement inevitably moves the water inlet attached to the pump such that eventually the water inlet within the tank is moved and pulled out of the water causing it to run without water and resulting in costly damage to the pump.

Also, pumps used in these prior art systems are high flow pumps such that more water is wasted due to overflow at the pump outlet than is used in the mist. Additionally, openings in the prior art tank tops are used as handles but the openings are often result in the tank being mistaken as a trash receptacle.

Further, by way of example only and not limitation, other prior art issues include the fact that there is no way to transport tanks and associated pumps and fans in a secure and compact manner.

Thus, there is a need in the art for a portable mist fan and tank combination that is robust and flexible so as to accommodate a full spectrum of shapes and dimensions and that addresses these prior art problems including but not limited to fan and pump movement during operation resulting in causing damage to the pump; prevention of trash introduction to the tank and ease of storing and transporting multiple tanks and associated fans and pumps.

It therefore is an object of this invention to provide an improved portable mist fan and tank device that obviates these prior art problems and that is easy to use and economical to install and operate.

SUMMARY

Accordingly, an improved portable mist fan and tank apparatus consists of a round lid with a base receiver recess, a pump where the pump includes an inlet and an outlet for fluid, a fan where the pump outlet is located in proximity to the fan, a base connected with the pump and the fan, the base configured to fit within and be retained by the base receiver recess when the base is located on the round lid and a tank with an exterior with a round top and a bottom and an interior for containing fluid, where the round lid is rotatably attached with the round top of the tank such that movement of the base moves the round lid and where the exterior bottom of the tank matches the base receiver recess such that the exterior bottom of the tank fits within the base receiver recess of the round lid when the base is removed and where the interior has a bottom recess where the interior bottom recess is configured to match the base such that the base fits within and is retained by the interior bottom recess when the base is located within the interior of the tank.

In one aspect, the apparatus further includes a pressure switch connected with the pump inlet such that pump operation without fluid is prevented.

In one aspect, the apparatus includes a fan stand where the fan is movably connected with the fan stand.

In another aspect, the base receiver recess is rectangular and the exterior bottom of the tank is conformed to the rectangular base receiver recess so as to receive and retain the rectangular exterior bottom of the tank such that tanks are stackable one on top of the other when the base is removed and where the interior bottom recess is conformed to the rectangular base receiver recess and the base is conformed to the rectangular base receiver recess such that the base is received and retained in the interior of the tank in the rectangular interior bottom recess when the base is located in the interior of the tank.

In one aspect, the base receiver recess is a square.

In one aspect, the pump includes a primer bulb and high pressure drain valve.

In another aspect, the round lid includes locks to lock the round lid to the tank such that the round lid is rotatable around the top of the tank and locked to the tank.

In one aspect, the round lid overhangs the tank top such that lifting handles are provided by the round lid overhangs.

In one aspect, the tank includes a fluid inlet within the tank connected with the pump inlet and where the round lid is movable on the tank top such that when the base is located in the base receiver recess and the fan or pump are rotated the lid moves such that the relation of the fluid inlet within the tank and the pump inlet are not changed.

According to another embodiment, an improved portable mist fan and tank apparatus consists of a round lid with a base receiver recess, a pump where the pump includes an inlet and an outlet for fluid and where the pump provides pressures up to 1,200 psi and where the pump includes a primer bulb and high pressure drain valve, a fan where the pump outlet is located in proximity to the fan, a fluid input connected with the tank for supplying fluid to the tank, a base connected with the pump and said fan, the base configured to fit within and be retained by the base receiver recess when the base is located on the round lid; and a tank, with an exterior and an interior and a round top, for containing fluid where the round lid is rotatably attached with the round top of the tank such that movement of the base moves the round lid and where fluid in the tank supplies fluid to the pump inlet and where the tank includes a bottom with a first shape where the base receiver recess is conformed to the first shape so as to receive and retain the bottom of the tank such that tanks are stackable one on top of the other when the base is removed and where the tank interior has a bottom recess where the interior bottom recess is configured to match the base receiver recess such that the base fits within and is retained by the interior bottom recess when the base is located within the interior of the tank.

In one aspect, the apparatus further includes a pressure switch connected with the pump inlet such that pump operation without fluid is prevented.

In another aspect, the apparatus further includes a fan stand where the fan is movably connected with the fan stand.

In one aspect, the first shape is a rectangle.

In one aspect, the round lid includes locks to lock the round lid to the tank such that the round lid is rotatable around the top of the tank when locked to the tank.

In another aspect, the round lid covers the entire top of the tank and overhangs the tank top such that lifting handles are provided by the round lid overhangs and where wheels are removably attached to the tank bottom.

In one aspect, the tank includes a fluid inlet within the tank connected with the pump inlet and where the round lid is movable on the tank top such that when the base is located in the base receiver recess and the base is rotated the round lid moves such that the relation of the fluid inlet within the tank and the pump inlet are not changed.

According to another embodiment, an improved method for providing a portable mist fan consists of:

a. providing a round lid with a base receiver recess; a pump where the pump includes an inlet and an outlet for fluid; a fan where the pump outlet is located in proximity to the fan; a base connected with the pump and the fan, the base configured to fit within and be retained by the base receiver recess when the base is located on the round lid and a tank with an exterior with a round top and a bottom and an interior for containing fluid, where the round lid is rotatably attached with the round top of the tank such that movement of the base moves the round lid and where the exterior bottom of the tank is configured match the base receiver recess and fit within the base receiver recess of the round lid when the base is removed and where the interior has a bottom recess where the interior bottom recess is configured to match the base such that the base fits within and is retained by the interior bottom recess when the base is located within the interior of the tank; and b. adding fluid to the tank.

In one aspect, the base receiver recess is rectangular and the tank includes a rectangular bottom conformed to the rectangular base receiver recess so as to receive and retain the rectangular bottom of the tank such that tanks are stackable one on top of the other when the base is removed and where the interior bottom recess is conformed to the rectangular base receiver recess and the base is conformed to the rectangular base receiver recess such that the base is received and retained in the interior of the tank in the interior bottom recess when the base is located in the interior of the tank.

In another aspect, the round lid includes locks to lock the round lid to the tank such that the round lid is rotatable around the top of the tank while locked to the tank, where the round lid covers the entire top of the tank and overhangs the tank top such that lifting handles are provided by the round lid overhangs and where wheels are removably attached to the tank bottom.

In one aspect, the tank includes a fluid inlet connected with the pump inlet and where the round lid is movable on the tank top such that when the base is located in the base receiver recess and the base is rotated the round lid moves such that the relation of the fluid inlet within the tank and the pump inlet are not changed.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
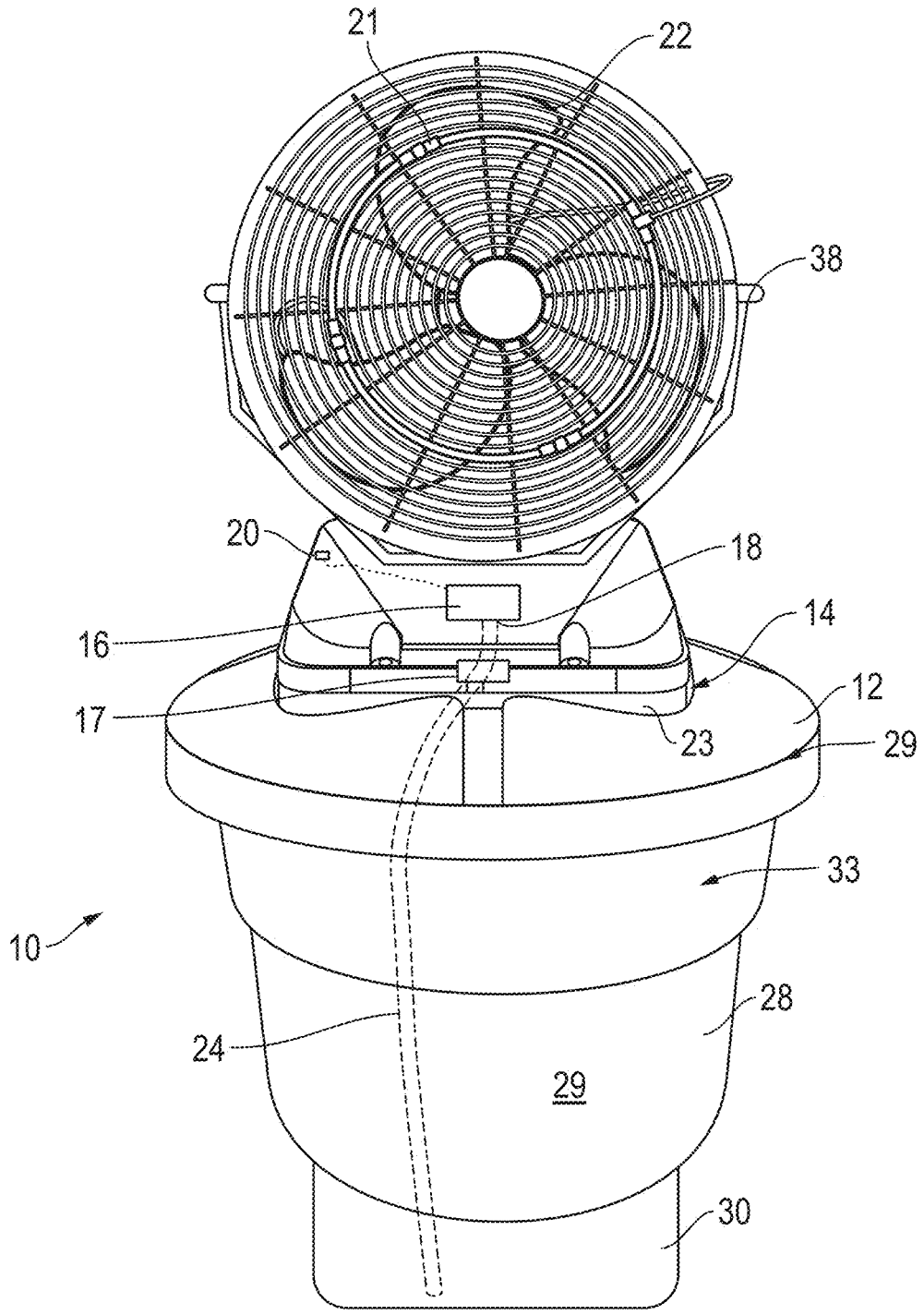
FIG. 1 is a front view of the improved portable mist fan and tank of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described method may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

One embodiment of the present invention is illustrated by way of example in FIGS. 1-11. With reference to FIG. 1, improved portable mist fan and tank apparatus 10 includes a round lid 12 with a base receiver recess 14 and a tank 28. A pump 16 includes an inlet 18 and an outlet 20 for fluid. Outlet 20 from pump 16 may preferably be connected with a mist nozzle 21 in front of fan 22 as illustrated. Also, preferably, the pump 16 is a low flow high pressure pump providing pressures up to 1,200 psi.

A pressure switch 17 connected before pump inlet 18 is provided to prevent operation of the pump 16 without fluid pressure being present. The pump outlet 20, in the form of mist nozzle 21 for example only, is located in proximity to the fan 22. A fluid inlet 24 is connected with the pump inlet 18. Fluid inlet 24 is preferably a flexible tube located within tank 28 such that fluid in tank 28 is drawn from tank 28 into pump inlet 18 by pump 16 when in operation. Fluid inlet 24 is long enough to reach the bottom 30 of tank 28 so that all the fluid within tank 28 is available for use as will be described more fully hereafter.

Importantly, base 23 is connected with pump 16 and fan 22. Base 23 may be a separate structure or the exterior of pump 16 and fan 22 in a molded form, for example only and not by limitation. According to a preferred embodiment, the base 23 is configured to fit within and be retained by the base receiver recess 14 when the base 23 is located on the round lid 12 as shown.

Further, tank 28 has an exterior 29 with a round top 31 and a bottom 30 and an interior 33 for containing fluid (not shown for clarity), where the round lid 12 is rotatably attached with the round top 31 of the tank 28 such that movement of the base 23 moves the round lid 12.

Figure 3:
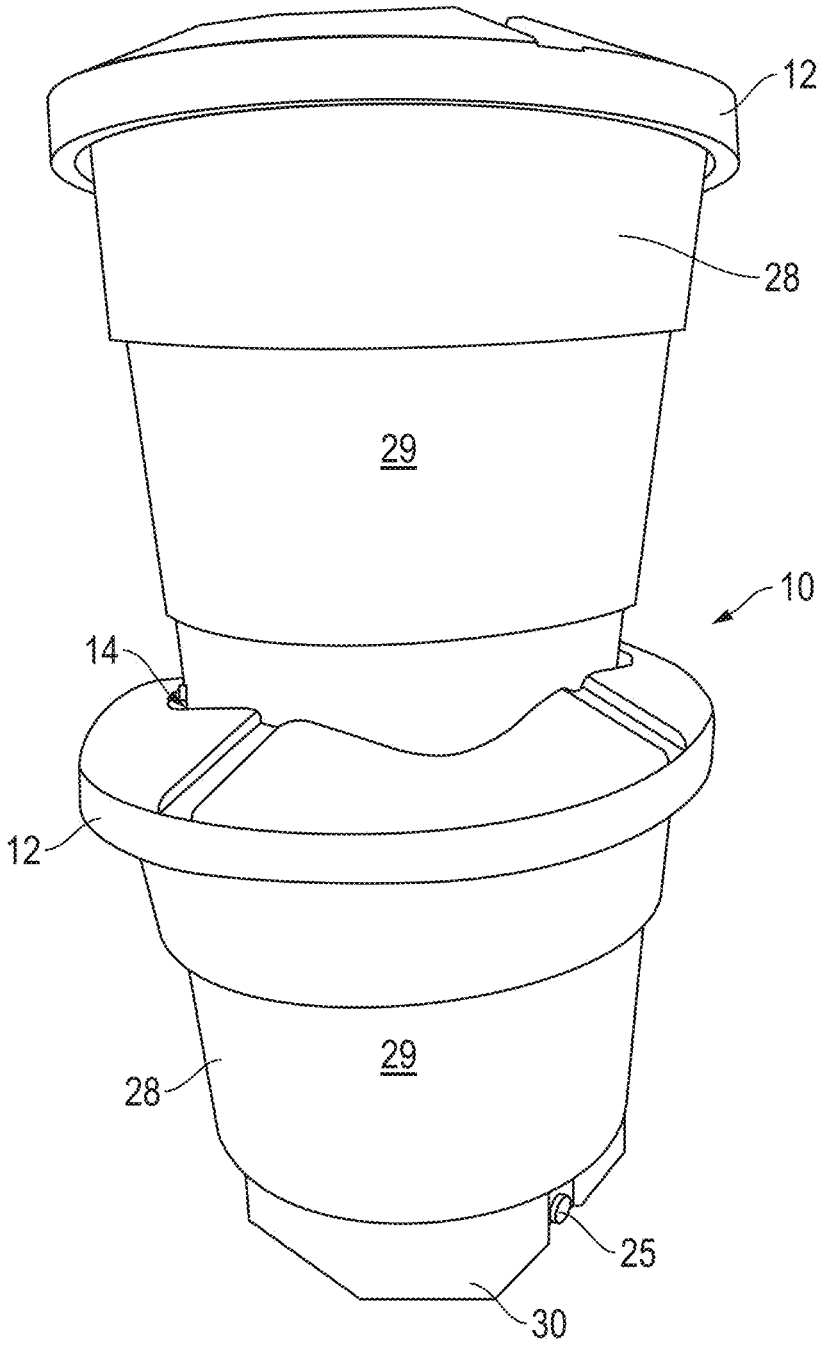
FIG. 3 is a perspective view of the invention of FIG. 1 showing the stacking of tanks.

The exterior 29 bottom 30 of the tank 28, according to the invention, matches the base receiver recess 14 such that the exterior 29 bottom 30 of the tank 28 fits within the base receiver recess 14 of the round lid 12 when the base 23 is removed (See FIG. 3). Further, as more clearly shown in FIG. 10, the interior 33 of tank 28 has a bottom recess 36 where the interior bottom recess 36 is configured to match the base 23 such that the base 23 fits within and is retained by the interior bottom recess 36 when the base 23 is located within the interior 33 of the tank 28 as shown in FIG. 11.

Figure 2:
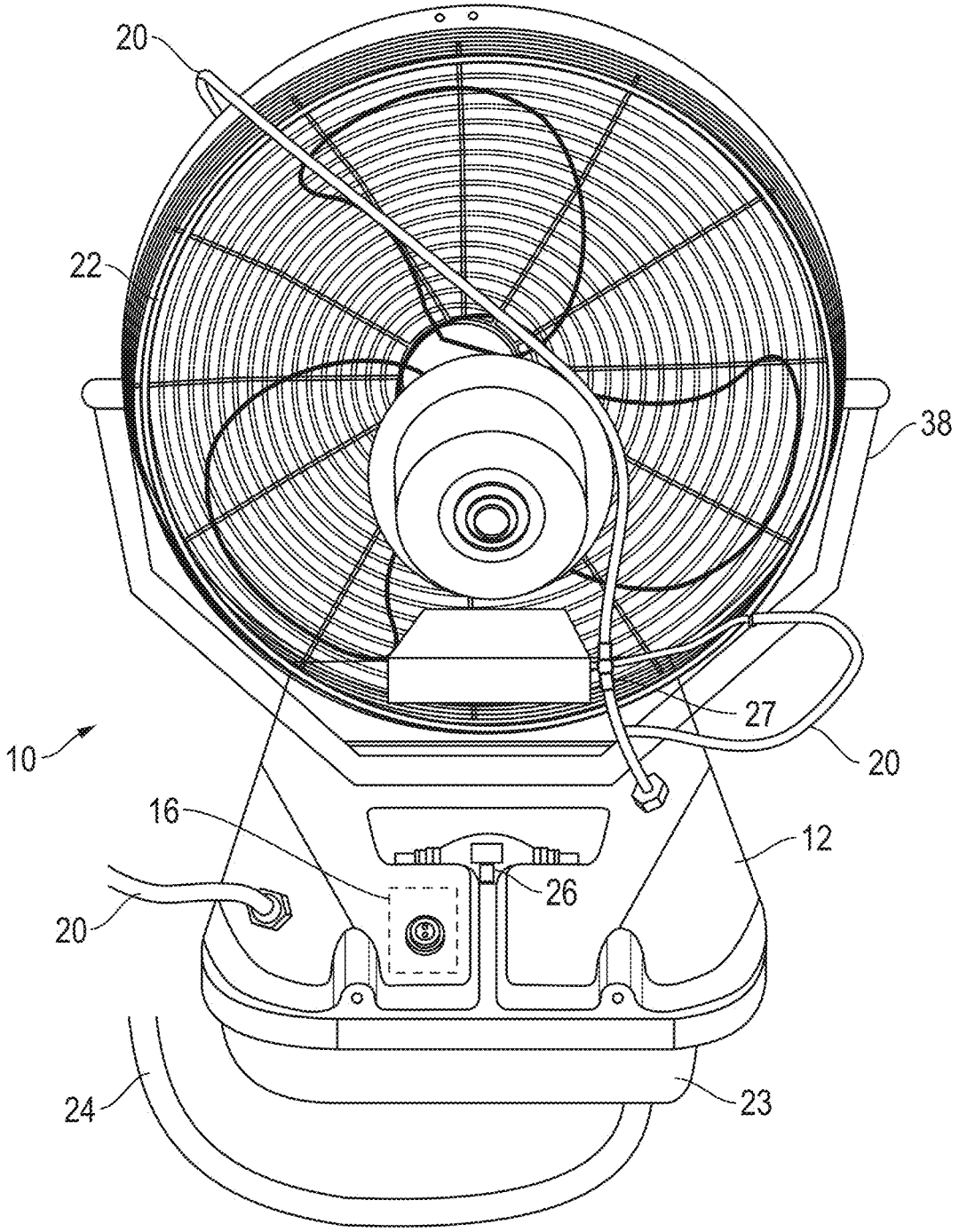
FIG. 2 is a close up perspective view of the fan and pump of the invention of FIG. 1 including a priming bulb and a high pressure relief valve.

FIG. 2 is a close up view of the pump 16 and fan 22 including a priming bulb 26 for priming pump 16. Priming bulb 26 operates as is known in the art and is connected with a high pressure drain 27 such that once primed, pump 16 operates with a ready source of fluid.

FIG. 3 illustrates the innovation of the present invention in which the base receiver recess 14 is rectangular in shape, preferably square. Any desired form is suitable that works in combination with tank 28. Tank 28 is configured to store fluid (not shown for clarity), water, for example only and, preferably, includes a bottom 30 that matches the shape of base receiver recess 14. For example only, and not by limitation, square bottom 30 fits within, extends into, square base receiver recess 14 in lid 12 such that tanks 28 are stackable when base 23 is removed as illustrated. This is a huge improvement in the art where there has previously been no way to connect and control multiple tanks 28 for transportation to and from locations.

FIG. 3 also shows fluid input 25 near the bottom 30 of tank 28. In use, fluid input 25 provides a means for connecting a fluid source to tank 28 for filling and maintaining fluid level within tank 28. A common hose connection may serve as fluid input 25. Further, when desired, fluid input 25 may be opened, a hose removed for example, or a cap removed, etc., and fluid allowed to drain out of tank 28.

Figure 5:
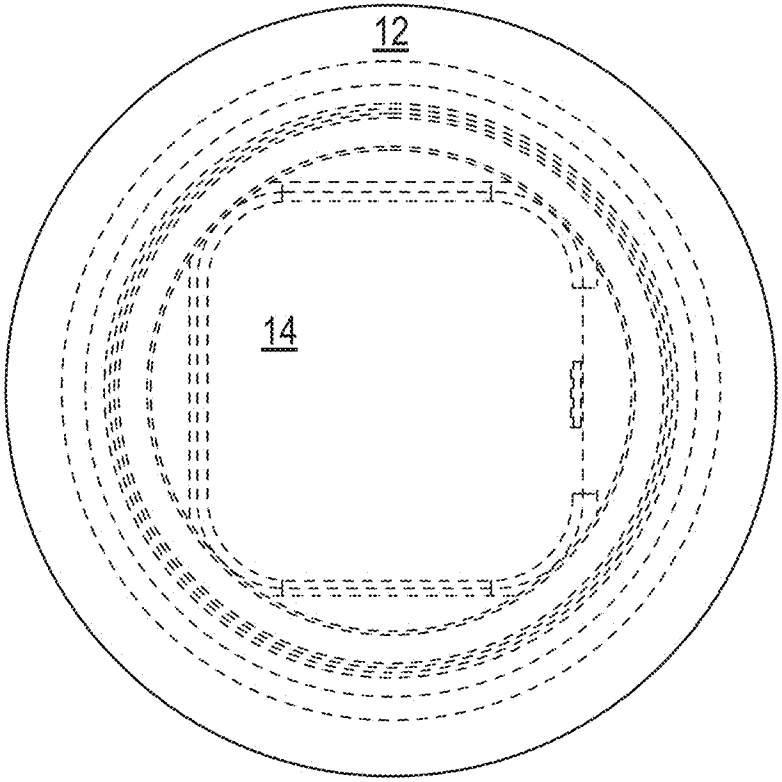
FIG. 5 is a bottom view of the tank with a square bottom shape.
Figure 4:
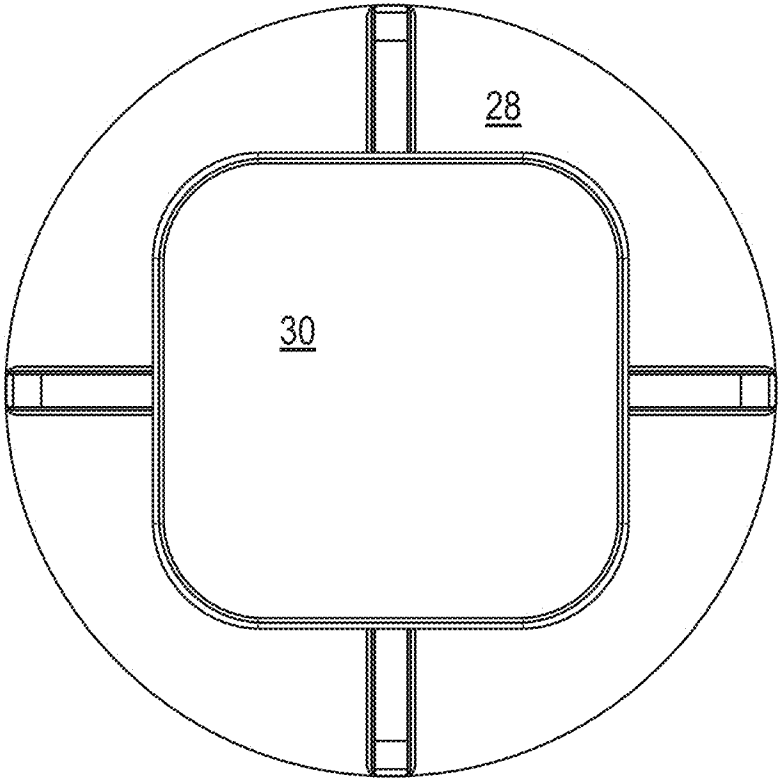
FIG. 4 is a top view of the lid with a rectangular base receiver recess.

FIGS. 4 and 5 show a side by side of the square form bottom 30 of tank 28 and the lid 12 with a matching form base receiver recess 14 into which bottom 30 fits.

Figure 6:
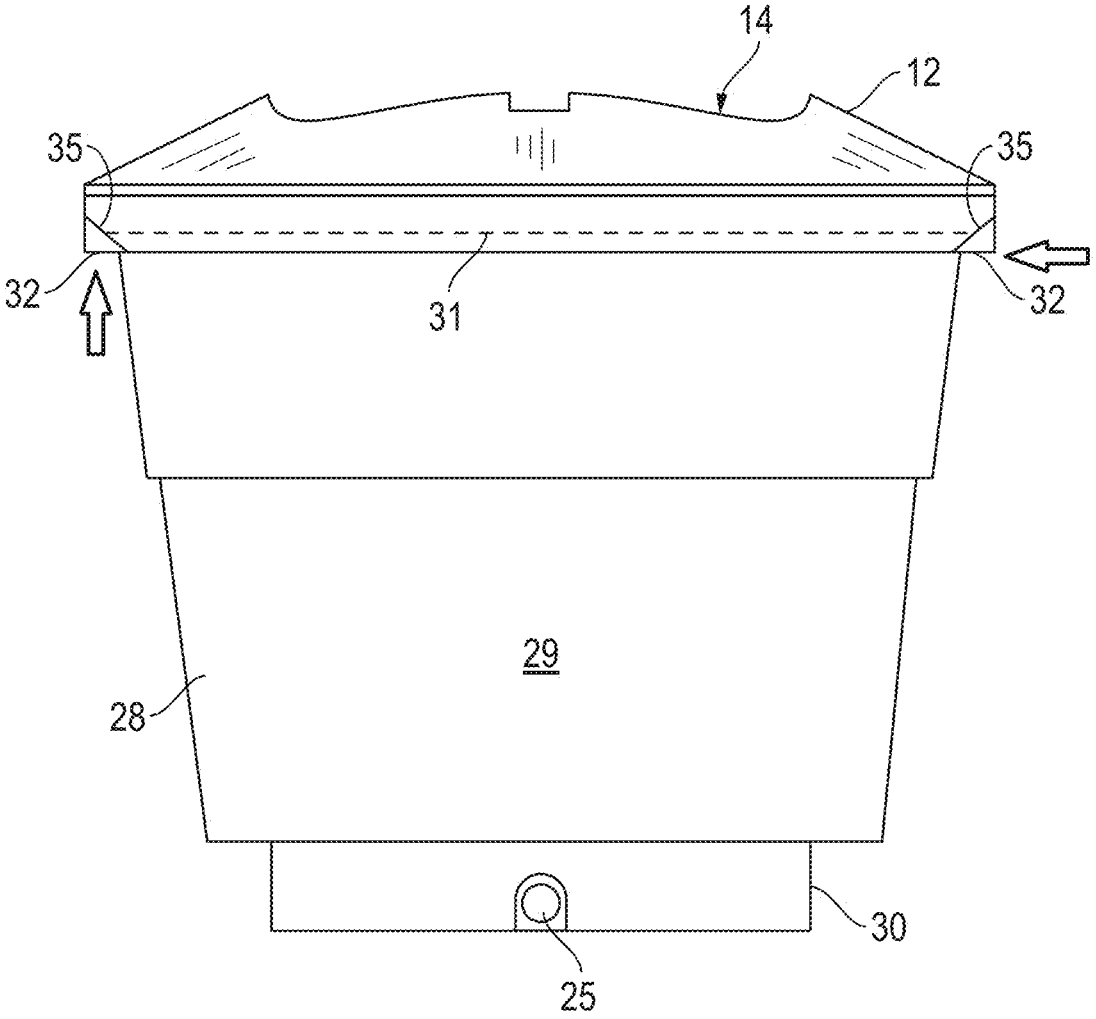
FIG. 6 is a side view of the invention of FIG. 1 showing the handles provided by the lid overhang.

FIG. 6 shows the innovation of the present invention with the round lid 12 attached with tank 28 such that an overhang 32 is provided. Lid overhang 32 creates lifting surfaces or handles for movement of the apparatus. This solves the problem of prior art devices that use holes in the lid for lifting but into which trash is introduced in the mistaken belief the tank 28 is a trash can. Further the round lid 12 of the present invention covers the entire round top 31 of tank 28 such that fluid within the tank 28 is prevented from spilling out of the tank 28. This is particularly important when the fluid in the tank 28 is a chemical bug spray, deodorant or some other similar substance.

Additionally, FIG. 6 illustrates locks 35 that lock round lid 12 to the round top 31 of tank 28 but which, importantly, still enable round lid 12 to rotate around the round top 31 when round lid 12 is moved. Again, a major downside of prior art mist and tank combinations is that movement of the fan and pump moves the pump inlet 18 relative to the fluid inlet 24 such that fluid inlet 24 is pulled up and out of the fluid causing the pump 16 to run without fluid and damaging the pump 16. Thus, locks 35, while securing round lid 12 in place to the round top 31 of tank 28, still allow pump inlet 18 and fluid inlet 24 to remain in the same relative position to each other while keeping fluid inlet 24 in fluid at all times even when round lid 12 is moved as happens when the fan 22 is adjusted, for example only.

Locks 35 may be an angled section of round lid 12 that grips the round top 31 by compression fit, as shown by direction arrows, for example only, or any other lock device now known or hereafter developed.

Figure 7:
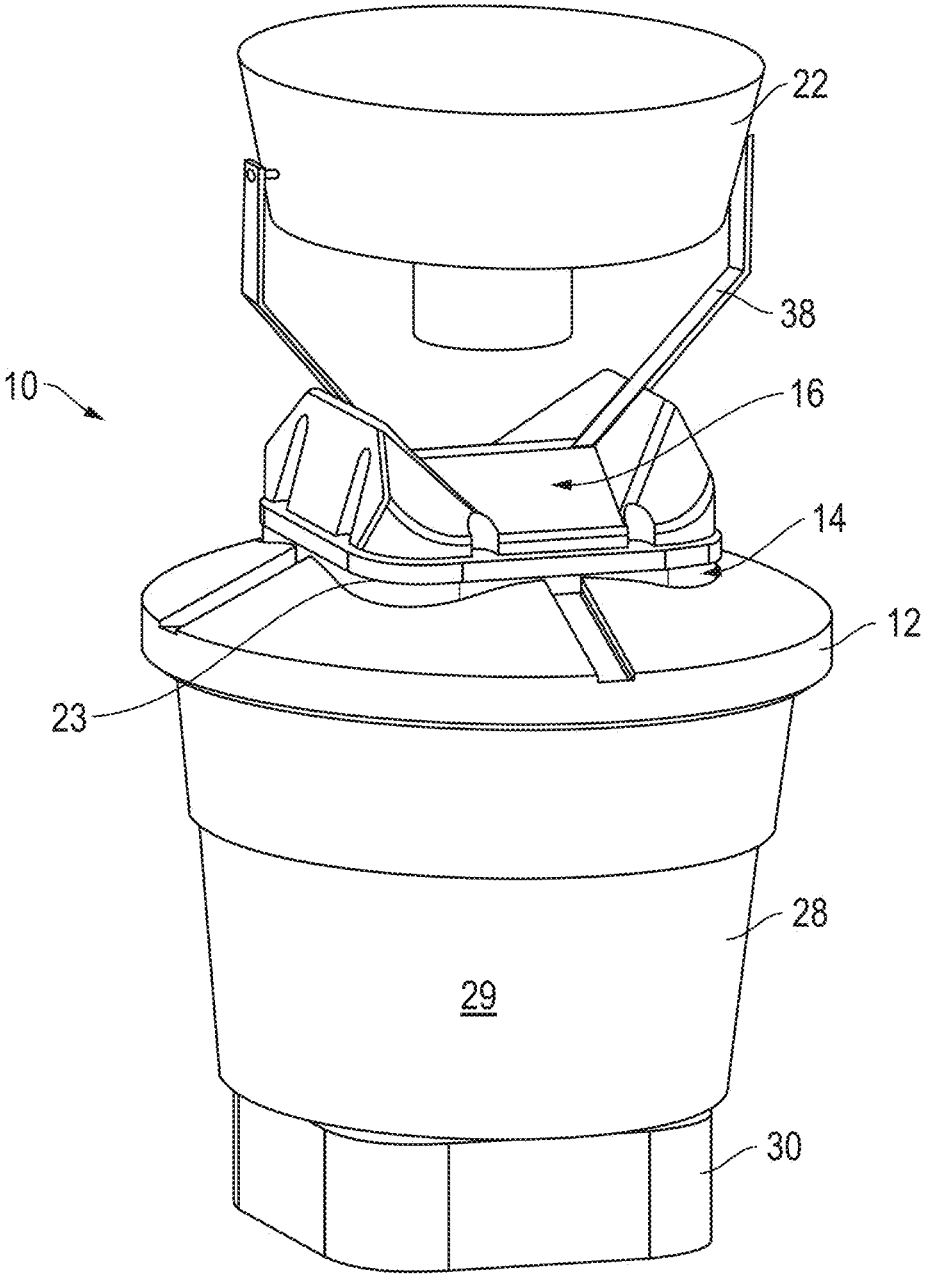
FIG. 7 shows the invention of FIG. 1 with the fan and pump located in the square base receiver recess in the lid located on a tank and the fan attached to a fan stand.

FIG. 7 shows the present invention with the fan 22 connected with a fan stand 38 such that the fan 22 is adjustable as illustrated with fan 22 facing upward from the round lid 12. In this format, movement of the fan stand 38 connected to round lid 12 by base 23 may or may not move round lid 12 while fan 22 is adjusted as desired. That is, here fan 22 adjustment is independent of movement of round lid 12.

Figure 8:
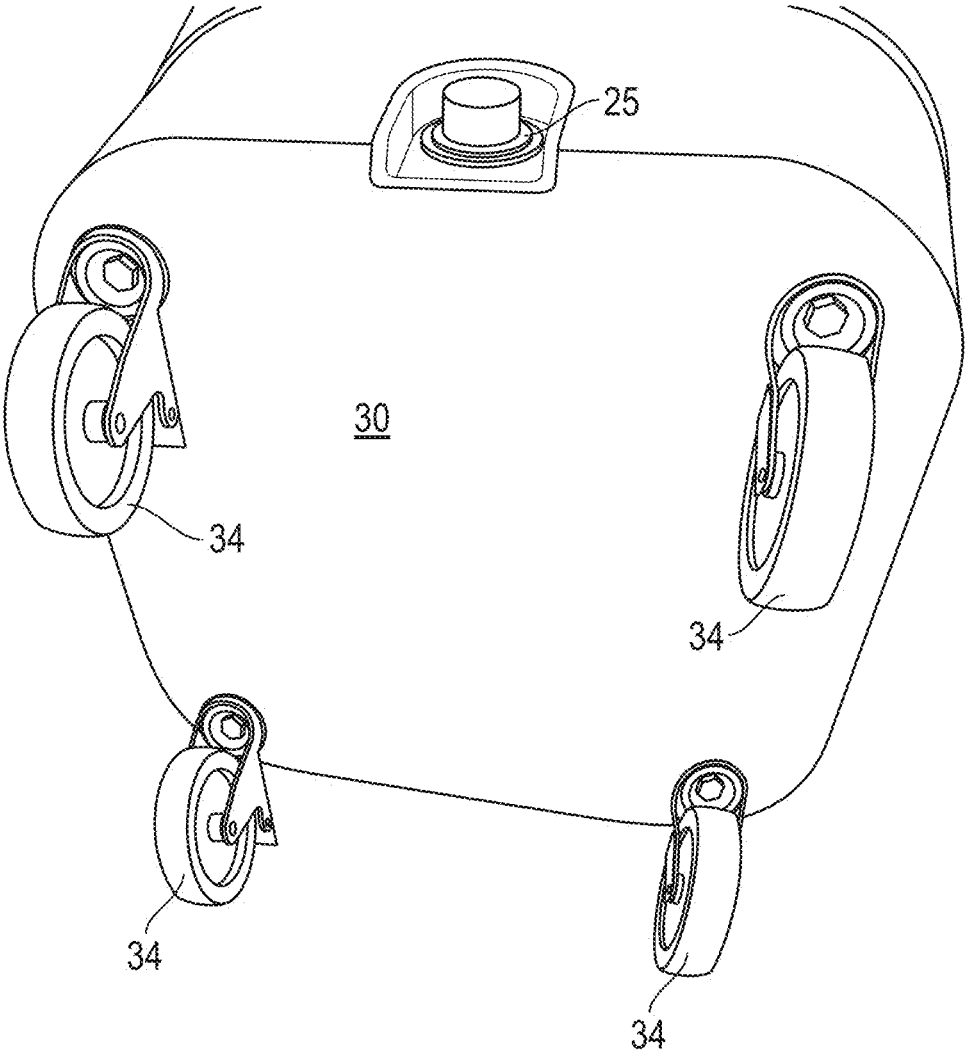
FIG. 8 is a bottom view of the tank of invention of FIG. 1 with optional wheels.

FIG. 8 shows the bottom 30 of tank 28 with wheels 34 removably attached to bottom 30. The provision of easily attached and removed wheels 34 greatly enhances the ability of a user to locate improved portable mist fan and tank apparatus 10 where most useful even after tank 28 is filled with fluid. FIG. 8 also illustrates fluid input 25 as discussed herein.

Figure 9:
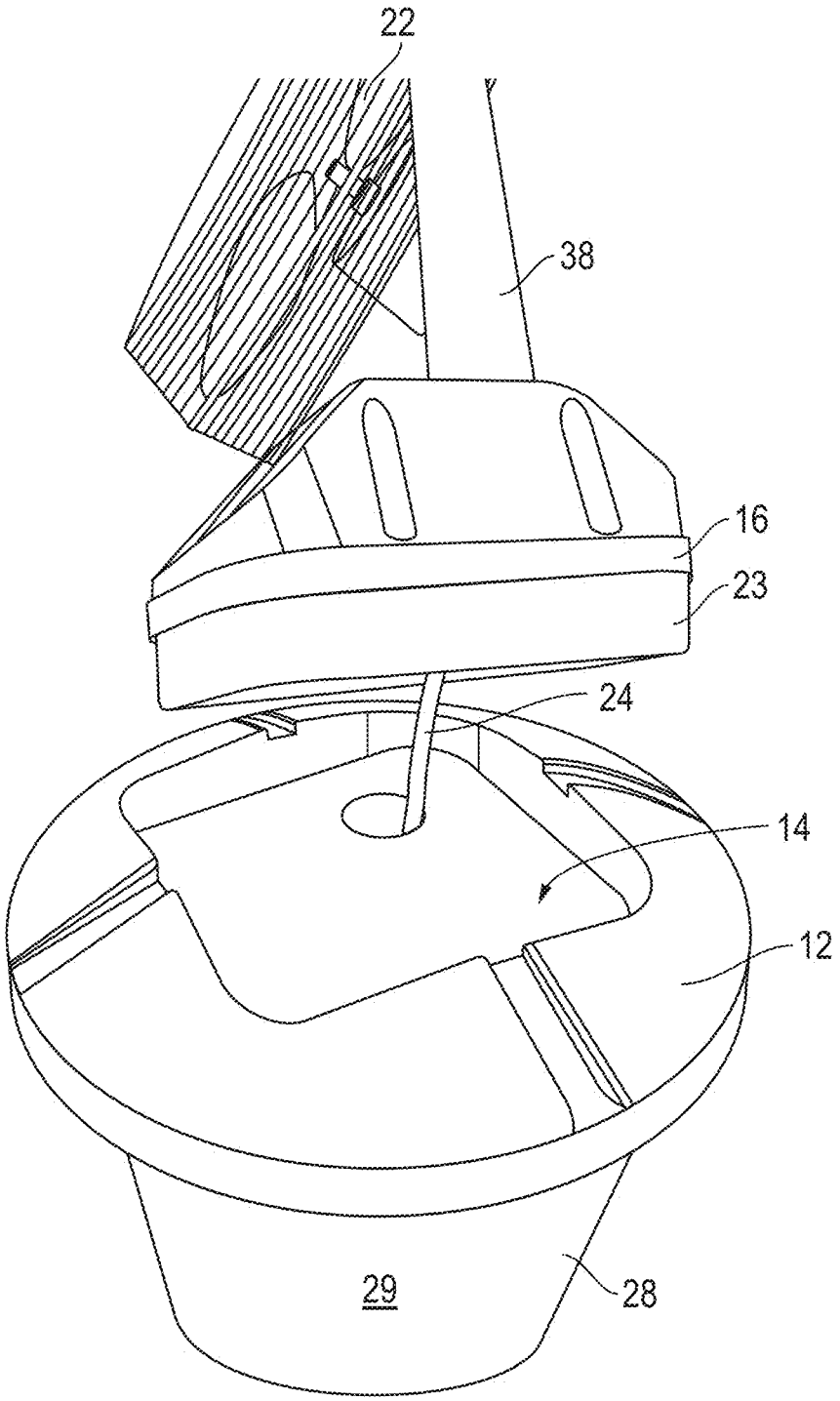
FIG. 9 is a side view with the base positioned above the base receiver recess.

FIG. 9 shows base 23, connected with pump 16 and fan 22, positioned above base receiver recess 14. Round lid 12 is connected with tank 28.

Figure 10:
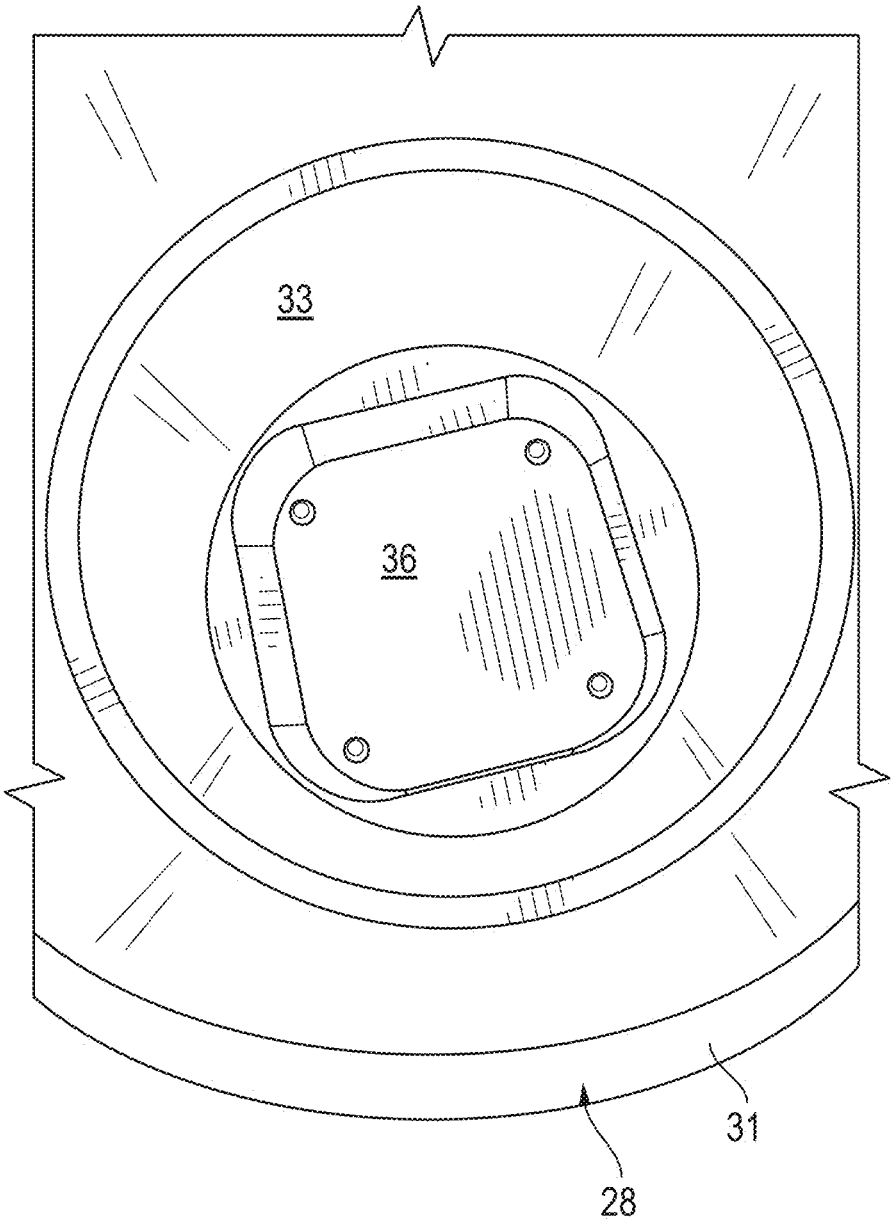
FIG. 10 is a top view of the interior of the tank showing the interior bottom recess.
Figure 11:
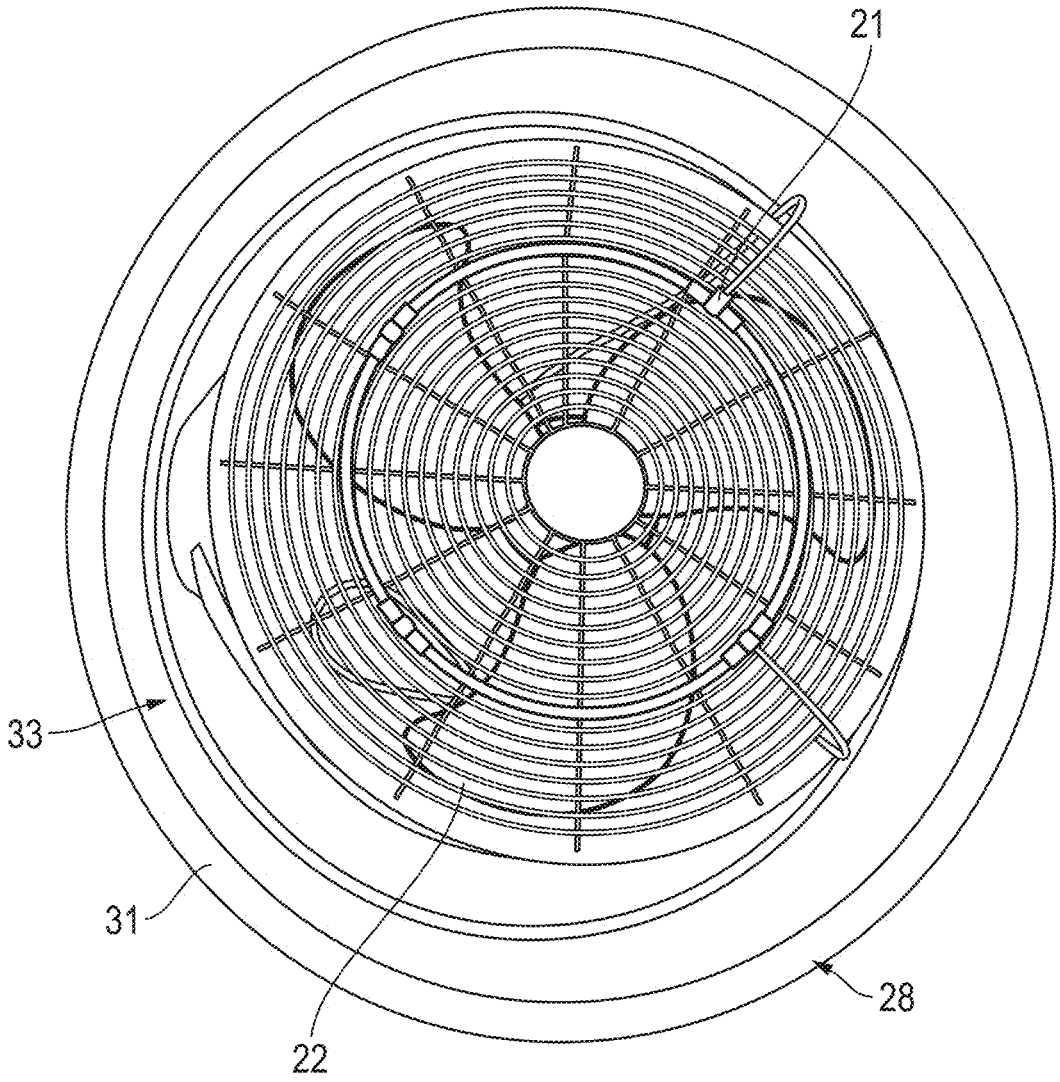
FIG. 11 is a top view with the base, pump and fan located in the interior of the tank.

FIG. 10 is a top view showing the interior 33 of tank 28 and the bottom recess 36. Round top 31 of tank 28 is also clearly illustrated.

FIG. 11 is a top view of FIG. 10 with base 23, along with pump 16 and fan 22, located in bottom recess 36 on the interior 33 of tank 28. This structure greatly facilitates the safe and secure transportation of the pump 16 and fan 22, as well as all other associated elements. They are prevented from movement when the base 23 is placed in bottom recess 26 and secured within tank 28 when round lid 12 is locked in place as described. Previously, all these elements were shipped separately or grouped haphazardly in open tanks or the like.

By way of further description, the present invention is designed for cooling, dust control, odor control, bug control, fog effects and humidification as are prior art devices. The deficiencies in the prior art, however, are many. To begin with, among other things, prior art units do not include an easy way to prime the pump. Prior art units require a person to take out a nozzle and place their finger over the nozzle hole. Next, the pump is turned on and as the pressure build up, the person removes their finger. This often must be done ten times or more and then hopefully the pump will prime. Then the pump is turned off and the nozzle screwed back into place. The pump can then be turned on in the hope that it will work. If it does not work, the process must be repeated.

The present invention provides two things that will positively, one hundred percent prime its pumps without the user ever having to take parts out of the unit. First, the present invention includes a rubber hand pump, priming bulb 26, that is molded into the round lid 12 of the present invention. The present invention also uses a high pressure drain valve 27 that works in conjunction with the priming bulb 26. As the user pushes the priming bulb 26, the high pressure drain valve 27 allows the water to flow through while letting the air out. Once the air is out of the line, the user can then turn on the pump 16 while pushing the priming bulb 26. The pump 16 will then instantly prime and the invention with the fan 22 in operation will automatically start dispensing mist, closing off the high pressure drain valve 27.

Additionally, prior art units in this class are not stackable and do not lock together in any way. This means that there is less room for storage. The present invention has a unique stack and store design not seen in other systems. With the bottom 30 of the tank 28 being formed in a square, for example only, matching the base receiver recess 14 in the round lid 12, users can securely stack units since they interlock together and use less room for storage.

Still further, prior art units in the same class have handles that leave openings to the inside of the water tank. This is a big problem because, in a commercial atmosphere, for example, these openings often result in the tank being mistaken as a trash receptacle. This introduces a wide array of trash into the tank and fluid used for the misting fans. The present invention utilizes a roll over lip overhang 32 as the carry handle and the round lid 12 to the unit covers the entire round top 31 opening of the tank 28 and can be locked with locks 35 when needed to prevent people from putting any type of trash into the tank 28.

Further, prior art units with a pump and fan connected to a round lid cause customers to feel as if the unit can be rotated 360 degrees, when in fact, if the prior art unit is turned in any way, the water pick up tube, fluid inlet 24, is pulled out of the water and eventually, without access to water, the pump 16 will burn out. The present invention provides a pump 16 and fan 22 connected to base 23 that is housed/retained in base receiver recess 14. In that manner, fan 22 and pump 16 are also secured with the round lid 12 within base receiver recess 14 in lid 12. Here however, because round lid 12 is secured with the round top 31 of tank 28 such that round lid 12 is free to rotate, when a customer turns the fan 22 or the pump 16 or the fan stand 38, the round lid 12 can turn 360 degrees and still ensure that the pickup tube, fluid inlet 24, stays completely in the water so that the pump 16 does not burn out. That is, the relation of the pump inlet 18 to the fluid inlet 24 remains unchanged and the fluid inlet 24 is not dragged out of the fluid.

Importantly, with base 23, along with pump 16 and fan 22, located in bottom recess 26 on the interior 33 of tank 28, the safe and secure transportation of the pump 16 and fan 22, as well as all other associated elements is provided. The delicate pump 16 and fan 22 are prevented from movement when the base 23 is placed in bottom recess 26 and secured within tank 28 when round lid 12 is locked in place as described. Previously, all these elements were shipped separately or grouped haphazardly in open tanks or the like.

Again, preferably, the present invention utilizes a low flow, high pressure mist pump 16. By using a low flow, high pressure pump (up to 1200 psi), there is no need to bypass and/or waste the water.

In sum, individuals want an affordable professional grade high-pressure mister with just one small fan and a tank. The invention of FIGS. 1-11 is light weight, compact and easy to move around.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. An improved portable mist fan and tank apparatus comprising: a. a round lid with a base receiver recess; b. a pump, wherein the pump includes an inlet and an outlet for fluid; c. a fan, wherein the pump outlet is located in proximity to the fan; d. a base connected with said pump and said fan, the base configured to fit within and be retained by said base receiver recess when said base is located on said round lid; and e. a tank with an exterior, a round top, a bottom and an interior for containing fluid, wherein the round lid is rotatably attached with the round top of the tank such that movement of the base moves the round lid; and wherein the exterior bottom of said tank matches the base receiver recess such that the exterior bottom of the tank fits within the base receiver recess of the round lid when said base is removed; and wherein the tank interior has a bottom recess, wherein the interior bottom recess is configured to match the base such that said base fits within and is retained by said interior bottom recess when said base is located within the interior of said tank.

2. The apparatus of claim 1, further including a pressure switch connected with the pump inlet such that pump operation without fluid is prevented.

3. The apparatus of claim 1, further including a fan stand, wherein the fan is movably connected with the fan stand.

4. The apparatus of claim 1, wherein the base receiver recess is rectangular and the exterior bottom of said tank is conformed to the rectangular base receiver recess so as to receive and retain the rectangular exterior bottom of the tank such that tanks are stackable one on top of each other when the base is removed and wherein the interior bottom recess is conformed to the rectangular base receiver recess and the base is conformed to the rectangular base receiver recess such that said base is received and retained in the interior of said tank in the rectangular interior bottom recess when said base is located in the interior of said tank.

5. The apparatus of claim 4, wherein the base receiver recess is a square.

6. The apparatus of claim 1, wherein the pump includes a primer bulb and high a pressure drain valve.

7. The apparatus of claim 1, wherein the round lid includes locks to lock the round lid to the tank such that the round lid is rotatable around the top of the tank and locked to the tank.

8. The apparatus of claim 1, wherein the round lid overhangs the tank top such that lifting handles are provided by the round lid overhangs.

9. The apparatus of claim 1, wherein the tank includes a fluid inlet within the tank connected with the pump inlet and wherein the round lid is movable on the tank top such that when the base is located in the base receiver recess and the fan or pump are rotated the lid moves such that a relation between the fluid inlet within the tank and the pump inlet is not changed.

10. An improved portable mist fan and tank apparatus comprising: a. a round lid with a base receiver recess; b. a pump, wherein the pump includes an inlet and an outlet for fluid and wherein the pump provides pressures up to 1,200 psi and wherein the pump includes a primer bulb and high pressure drain valve; c. a fan wherein the pump outlet is located in proximity to the fan; d. a fluid input connected with the tank for supplying fluid to the tank; e. a base connected with said pump and said fan, the base configured to fit within and be retained by said base receiver recess when said base is located on said round lid; and f. a tank, with an exterior, an interior and a round top, for containing fluid wherein the round lid is rotatably attached with the round top of the tank such that movement of the base moves the round lid and wherein fluid in the tank supplies fluid to the pump inlet and wherein the tank includes a bottom with a first shape wherein the base receiver recess is conformed to the first shape so as to receive and retain the bottom of the tank such that tanks are stackable one on top of each other when the base is removed and wherein the tank interior has a bottom recess, wherein the interior bottom recess is configured to match the base receiver recess such that said base fits within and is retained by said interior bottom recess when said base is located within the interior of said tank.

11. The apparatus of claim 10, further including a pressure switch connected with the pump inlet such that pump operation without fluid is prevented.

12. The apparatus of claim 10, further including a fan stand, wherein the fan is movably connected with the fan stand.

13. The apparatus of claim 10, wherein the first shape is a rectangle.

14. The apparatus of claim 10, wherein the round lid includes locks to lock the round lid to the tank such that the round lid is rotatable around the top of the tank when locked to the tank.

15. The apparatus of claim 10, wherein the round lid covers the entire top of the tank and overhangs the tank top such that lifting handles are provided by the round lid overhangs and wherein wheels are removably attached to said tank bottom.

16. The apparatus of claim 10, wherein the tank includes a fluid inlet within the tank connected with the pump inlet and wherein the round lid is movable on the tank top such that when the base is located in the base receiver recess and the base is rotated the round lid moves such that a relation between the fluid inlet within the tank and the pump inlet is not changed.

17. An improved method for providing a portable mist fan consisting of: a. providing a round lid with a base receiver recess; a pump wherein the pump includes an inlet and an outlet for fluid; a fan wherein the pump outlet is located in proximity to the fan; a base connected with said pump and said fan, the base configured to fit within and be retained by said base receiver recess when said base is located on said round lid; and a tank with an exterior, a round top, a bottom and an interior for containing fluid, wherein the round lid is rotatably attached with the round top of the tank such that movement of the base moves the round lid and wherein the exterior bottom of said tank is configured match the base receiver recess and fit within the base receiver recess of the round lid when the base is removed; and wherein the tank interior has a bottom recess, wherein the interior bottom recess is configured to match the base such that said base fits within and is retained by said interior bottom recess when said base is located within the interior of said tank; and b. adding fluid to the tank.

18. The method of claim 17, wherein the base receiver recess is rectangular and the tank includes a rectangular bottom conformed to the rectangular base receiver recess so as to receive and retain the rectangular bottom of the tank such that tanks are stackable one on top of each other when the base is removed and wherein the interior bottom recess is conformed to the rectangular base receiver recess and the base is conformed to the rectangular base receiver recess such that said base is received and retained in the interior of said tank in the interior bottom recess when said base is located in the interior of said tank.

19. The method of claim 17, wherein the round lid includes locks to lock the round lid to the tank such that the round lid is rotatable around the top of the tank while locked to the tank, wherein the round lid covers the entire top of the tank and overhangs the tank top such that lifting handles are provided by the round lid overhangs and wherein wheels are removably attached to said tank bottom.

20. The method of claim 17, wherein the tank includes a fluid inlet connected with the pump inlet and wherein the round lid is movable on the tank top such that when the base is located in the base receiver recess and the base is rotated, the round lid moves such that a relation between the fluid inlet within the tank and the pump inlet is not changed.

* * * * *